United States Patent [19]

Whelchel et al.

[11] 4,011,888

[45] Mar. 15, 1977

[54] UNITARY ELEVATOR UP LEVEL CONTROL VALVE

[75] Inventors: Robert J. Whelchel, Dunwoody, Ga.; William A. P. Lawrence, Simi Valley, Calif.

[73] Assignee: Elevator Equipment Co., Los Angeles, Calif.

[22] Filed: Mar. 12, 1976

[21] Appl. No.: 666,235

[52] U.S. Cl. ..... 137/612.1; 91/400; 91/452; 137/596.13; 137/596.16

[51] Int. Cl.[2] ..... F15B 13/043

[58] Field of Search ..... 91/400, 452; 137/596.12, 596.13, 596.14, 596.16, 608, 612.1

[56] References Cited

UNITED STATES PATENTS 3,707,166 12/1972 Lawrence et al. ..... 137/596.16

FOREIGN PATENTS OR APPLICATIONS 1,378,345 12/1974 United Kingdom ..... 137/596.12

*Primary Examiner*—Alan Cohan
*Assistant Examiner*—Gerald A. Michalsky

[57] ABSTRACT

A hydraulic valve assembly for operating a hydraulic elevator is simplified in its construction by positioning the check valve for the up level control in axial alignment with the bypass valve in the same valve housing mutually guided on a central valve stem. Pressure for actuating the bypass valve is controlled by a direct acting valve element structurally mounted on the valve element of the up leveling check valve.

9 Claims, 3 Drawing Figures

23
89
90
24
40
39
38
11
41
36
37
10
35
14
55
50
13
42
49
43
44
15
45
12
56
47
52
48
51
18
80
46
P
M
57
74
66
17
58
69
22
22
16
67
73
72
60
63
65
21
68
85
64
71
70
79
78
20
75
77
61
62
76
25
29
27
28
26
31
19

23
90
24
11
40
39
38
36
89
37
10
41
27
25
29
28
26
31
14
35
50
55
13
42
43
49
44
15
45
19
12
56
52
51
47
18
48
46
80
57
74
66
58
69
22
22
67
73
72
60
63
65
21
68
85
71
64
70
79
78
20
75
77
61
62
76
P
M
17
16

UNITARY ELEVATOR UP LEVEL CONTROL VALVE

Attention is called to U.S. Pat. No. 3,707,166 for a Unit Valve for hydraulic elevator control and to United Kingdom Pat. No. 1378345 respecting Up Level Control upon which this invention is an improvement.

For hydraulic elevators and particularly those used in buildings hydraulic fluid under pressure is supplied to a hydraulic ram in order to lift the elevator, whereafter gravity is relied upon to permit the elevator to lower. During the time when the ram and in consequence the elevator is traveling upwardly, it is desirable to have the travel as fast as safety conditions permit. As the elevator reaches a floor level where it is to stop, it is not only desirable but necessary to have the speed decelerate during approach to the floor level in a fashion such that the deceleration occurs smoothly and relatively rapidly for a comparatively short travel before stopping at precisely the floor level. In making use of hydraulic fluid pressure with the attendant valving, adjustment of the equipment frequently becomes a critical factor in order to have the equipment perform in the expected manner and to the expected degree of accuracy. Despite careful calculations in machining the character of hydraulic elevator controls is such that as load on the elevator changes and particularly as the load is increased, up level travel may not continue to be substantially the same and dependable. Furthermore, devices of this kind are in constant operation once installed and servicing becomes a very troublesome problem when the valve construction is complicated and depends upon tolerances which may on occasions be difficult to hold with accuracy.

It is therefore among the objects of the invention to provide a new and improved unitary up level elevator control valve device which is relatively simple in structure and arrangement making it possible to build with a desirable degree of accuracy using substantially conventional tooling and manufacturing techniques.

Another object of the invention is to provide a new and improved unitary up level elevator control device wherein multiple valving is built and mounted in substantially axial alignment within a single housing whereby to improve the ease and accuracy of machining and as a consequence to be able to produce such a valve at a relatively lower cost.

Still another object of the invention is to provide a new and improved unitary elevator up level control valve wherein the structure for up level operation incorporates an adjustment which is accurate and of such character that the adjustment can be easily varied from the exterior of the valve housing in order to have the elevator perform precisely in accordance with desired characteristics.

Still another object of the invention is to provide a new and improved unitary elevator up level control device which is of such character that it operates with dependable accuracy and uniformity irrespective of loading.

With these and other objects in view, the invention consists in the construction, arrangement, and combination of the various parts of the device, whereby the objects contemplated are attained, as hereinafter set forth, pointed out in the appended claims and illustrated in the accompanying drawings. In the drawings:

Figure 1:
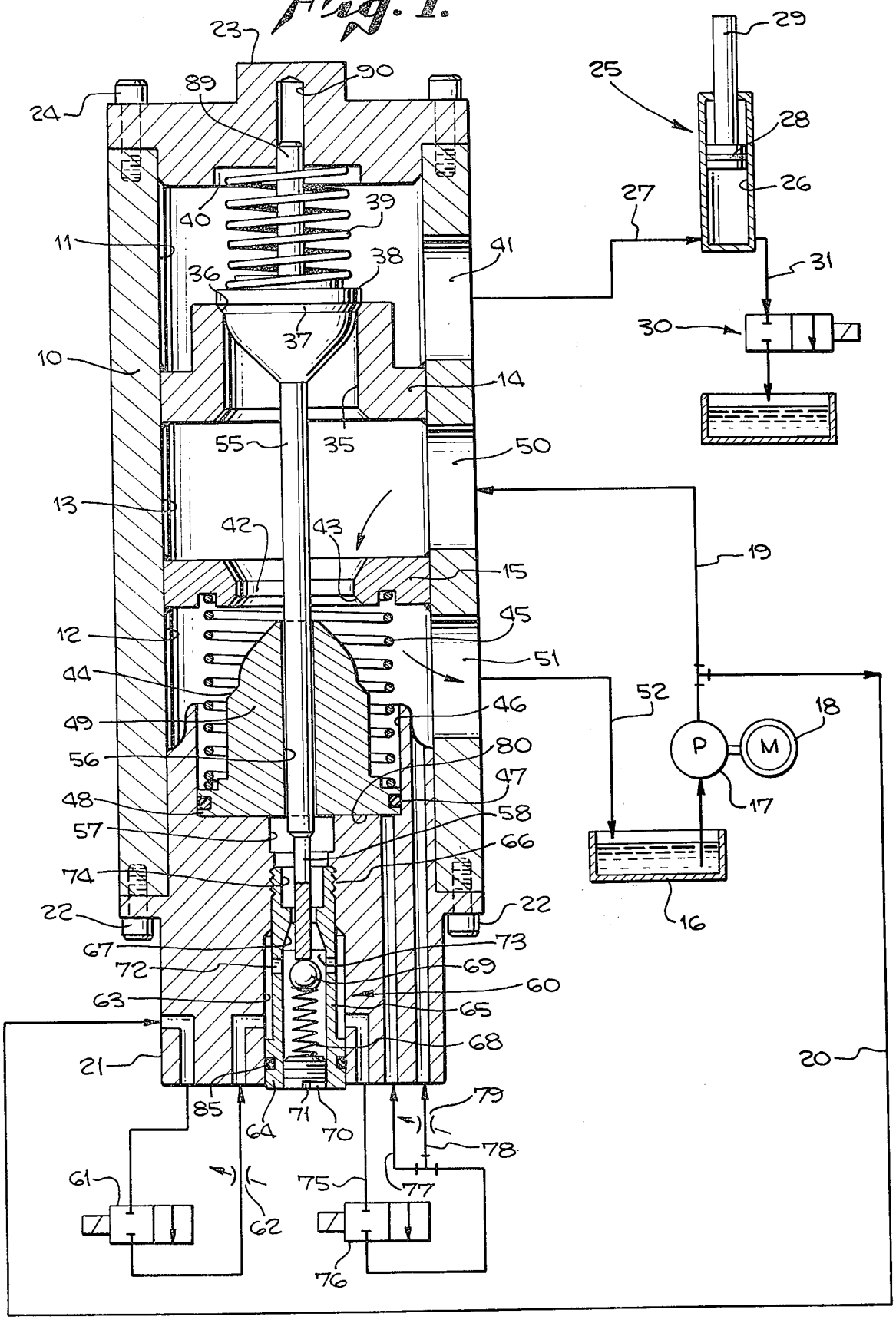
FIG. 1 is a longitudinal sectional view of the unitary elevator up level control valve device with parts in "at rest" position and showing other portions of the hydraulic circuit schematically.

In an embodiment of the invention chosen for the purpose of illustration the control valve is shown in a housing 10 providing a cylindrical interior consisting of an up travel supply chamber 11 at one end, a bypass chamber 12 at the other end, and an inflow chamber 13. A first partition 14 separates the up travel supply chamber from the inflow chamber and a second partition 15 separates the inflow chamber 13 from the bypass chamber 12.

Schematically shown on the right of the housing 10 is a reservoir 16 for hydraulic fluid from which a pump 17 operated by a motor 18 draws hydraulic fluid and passes the fluid under pressure through a supply line 19 to the inflow chamber 13. There is a second adjusting supply line 20 from the pump to a cap 21 at the lower end of the housing 10 as shown in FIG. 1. The cap 21 is secured to the housing 10 by means of bolts 22. A similar cap 23 at the opposite end is secured thereto by means of bolts 24.

The unitary elevator up level control valve shown in section is one adapted to supply a hydraulic cylinder 25. The cylinder is conventional and of a type customarily employed for raising and lowering the cab of a hydraulic elevator. Following conventional practice, a cylindrical chamber 26 receives hydraulic fluid under pressure from an up travel supply line 27 which acts against a piston 28 attached to a piston rod 29. Once elevated, the piston rod 29 is lowered by action of a down travel two-position solenoid 30 which, when shifted in a direction from right to left as viewed in FIG. 1 allows the hydraulic fluid to return through a return line 31 to the reservoir 16. This valve is shown schematically for reference only and is not a part of this invention.

The invention here under consideration is one specifically directed to a multiple valve device which operates first to initiate up travel of the ram and then slow it down as it reaches a specific height, the mechanism also including means for adjusting the up level operation.

More specifically, there is provided in the first partition 14 a check valve passage 35 at the upper end of which is a check valve seat 36 on which a check valve element 37 is adapted to seat, check valve element 37 being itself an integral part of check valve poppet 38. The check valve poppet 38 is normally biased to the closed position by operation of a spring 39 centered in a spring keeper recess 40, and is slidably guided in axial alignment by a rod 89 in guide bore 90.

In the second partition 15 there is a bypass passageway 42 at the lower end of which is a bypass valve seat 43 on which a bypass valve element 44 is adapted to seat.

In the cap 21 at the lower end as viewed in FIG. 1 there is provided a cylindrical guideway 46 which accommodates an annular seal 47 on a flange 48 of a piston 49 on which the bypass valve element 44 is located. The piston 49 is normally biased to the open position. When the bypass valve element is open as shown in FIG. 1 hydraulic fluid from the supply line 19 provided by the pump 17 is adapted to pass through an inflow orifice 50 to the inflow chamber 13, then through the bypass passageway 42 into the bypass chamber 12 and from there out through the bypass return orifice 51 through a return line 52 to the reservoir 16.

It is of consequence to note that a valve stem 55 which is an integral part of the check valve poppet 38 extends downwardly in axial alignment with the piston 49 and passes slidably through a bore 56 which is at the axial center line of the piston 49. The valve stem 55 is long enough so that its lower end extends into a pocket 57 and through the recess 74 by means of an extension 58. Because of this arrangement the piston 49 is adapted to move entirely independently of the valve stem 55 and in consequence the position of the check valve element 37.

Up leveling is in part accomplished by and also adjustable by manipulation of an up level adjustment valve device indicated generally by the reference character 60. For operating the up level adjustment valve device hydraulic fluid under pressure from the adjustment supply line 20 after passing through a two position up dump solenoid valve 61 and adjustable restrictor 62 finds its way through an annular cylindrical chamber 63 to the up level adjustment valve device 60.

The valve device is carried by a sleeve 64, a cylindrical reduced portion 65 of which extends through the annular cylindrical chamber 63 terminating in a threaded end 66 which is adapted to releasably attach the sleeve in operating position. The sleeve 64 further extends axially downwardly through the cap 21 and is provided with an annular seal 85 to prevent hydraulic fluid under pressure in the annular cylindrical chamber 63 from leaking to atmosphere.

Within the sleeve 64 is an up level adjustment valve port 67, frusto conical in shape upon which an up level adjustment valve element 69, of suitable shape, is adapted to seat. A spring 68 normally biases the up level adjustable valve element 69 in a seating direction, there being provided an adjusting screw 70 provided with an exterior wrench hold 71. Hydraulic fluid under pressure in the cylindrical chamber 63 finds its way through ports 72 to a space 73 adjacent the valve seat 67 and thence past the valve seat into a recess 74 and thence to the pocket 57.

When the up level adjusting valve element 69 is seated, thereby closing the up level adjusting valve device 60 the diverted hydraulic fluid is adapted to pass through a lead line 75 to a two position up level solenoid valve 76 which, when open, is adapted to pass the fluid to the respective branch lines 77 and 78. In the branch line 78 is an adjustable restriction 79.

In operation let it be assumed that the piston rod 29 is at rest and the parts of the unitary elevator up level control valve have the positions illustrated in FIG. 1. In this arrangement hydraulic fluid in the cylinder chamber 26 is trapped and the piston rod 29 remains stationary.

Although the stem 58 is shown as a single continuous section it could, for convenience in assembly, be made in two or more separate, axially aligned sections with upper one attached to the check valve element and a lower one extending slidably through the bypass valve element. Also the extension 58 with the valve element 69 attached may be separate from the lower section, or attached to it as shown.

DESCRIPTION OF OPERATION

For up travel the motor 18 being a substantially constant speed electric motor, is caused to rotate by means of a suitably actuated series of relays and switches, not disclosed. Rotational energy is imparted by any of various conventional means to the pump 17 urging it to impart further this substantially same energy into the hydraulic fluid in the reservoir 16 such that the fluid is given a level of energy substantially above that of atmospheric pressure such that this higher level of energy which the hydraulic fluid now possesses will be available at the cylinder 25 being delivered to the cylinder 25 through the conduits 19 and 27 after being suitably modulated as hereinafter described by the unitary elevator up level control valve subject of this invention.

Figure 2:
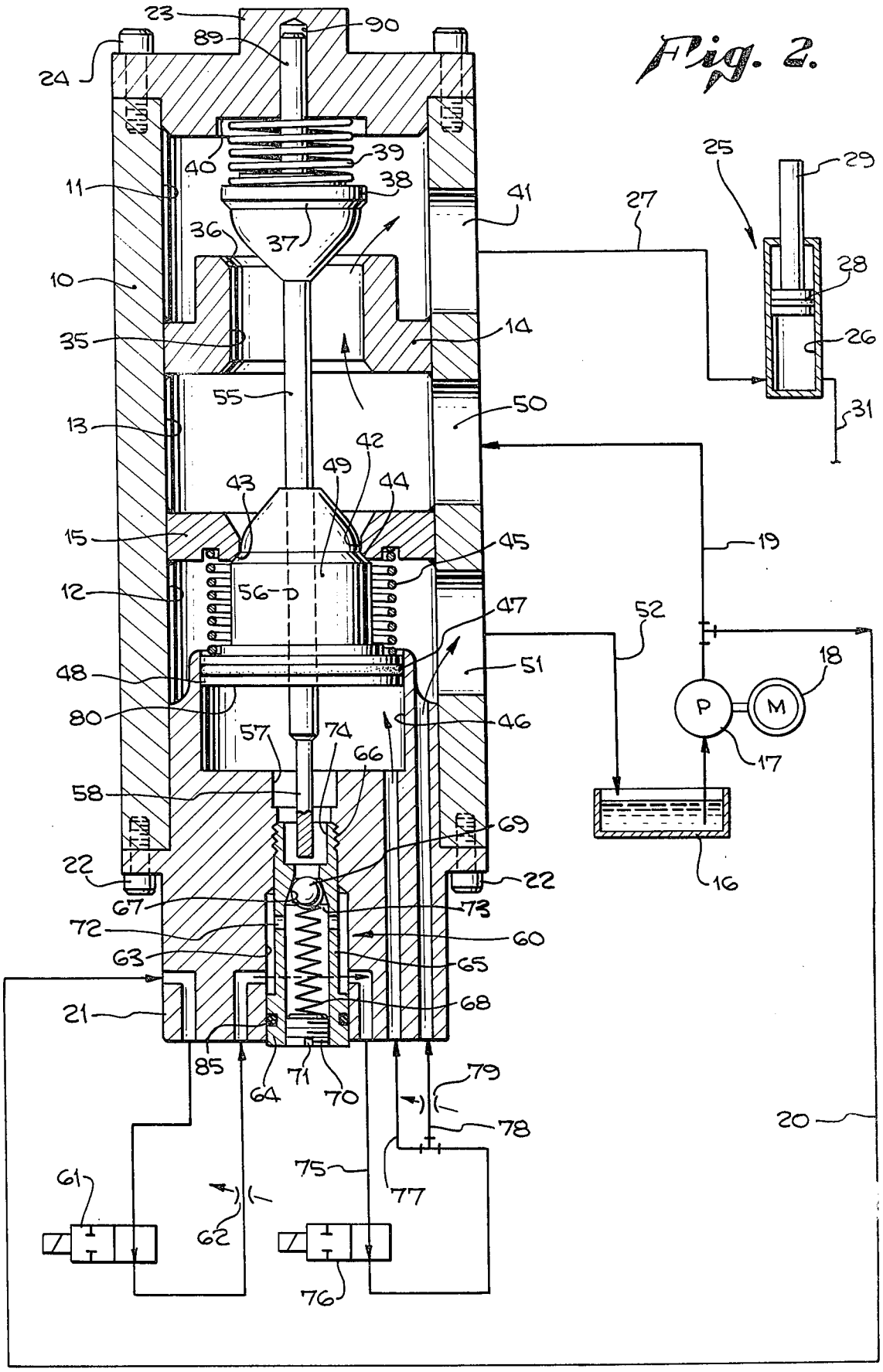
FIG. 2 is a longitudinal sectional view similar to FIG. 1 but showing the parts in position for up travel.

Simultaneous with the energization of the electric motor 18, the electrically operated means known as the Up-Dump solenoid 61 and Up Level solenoid 76 are caused to move from their closed positions shown in FIG. 1 to their open positions shown in FIG. 2, thereby allowing communication between conduit 20 and the extension of pocket 57 comprising the interior of the cylindrical guideway 46. This communication is accomplished by parallel circuitry through a plurality of passages. One circuit consists of the annular cylindrical chamber 63, ports 72, space 73, valve seat 67 and recess 74. The other circuit consists of conduit 75 in communication with annular cylindrical chamber 63, thence through Up-Level solenoid 76 and conduit 77 thence to the interior of the cylindrical guideway 46, itself being the extension of pocket 57. As noted, the conduit 77 has a branch line 78 having an adjustable restriction 79 and the conduit 20 has an adjustable restriction 62, these two restrictions being appropriately sized. In that way the hydraulic fluid in conduit 20 at high pressure is suitably modulated such that upon its arrival at the interior of cylindrical guideway 46 the high level of energy is impressed upon the lower face 80 of piston 49 exerting upward force on the piston 49 in proportional opposition to the downward force being exerted on piston 49 by the high energy hydraulic fluid being applied at inflow chamber 13 to the upper end of piston 49 in the ratio of their respective diametrical areas. The foregoing occurs despite the biasing force of spring 45, such that piston 49 is therefore urged to move upwardly at a rate determined by the aforementioned appropriately sized restrictions 62 and 79 until valve element 44 intimately contacts bypass valve seat 43. This results in effectively closing the bypass passageway 42 causing a rise in pressure at check valve passage 35 such that the combined forces of the spring 39 and the system pressure in conduit 27 impressed upon the top surface of check valve poppet 38 are overcome allowing check valve poppet 38 to move upwardly. Upward movement causes check valve element 37 to remove itself from intimate contact with check valve seat 35 thus establishing full area communication between inflow chamber 13 and up travel supply orifice 41.

A further consequence of the foregoing series of events is the upwardly axial displacement of the stem 55 and its extension 58 accompanied by the Up-Level adjustment valve element 69 which is urged into intimate contact with extension 58 under the insistance of spring 68. This continues until Up-Level valve adjustment element 69 is arrested in its upward travel by the intereference of the Up-Level adjustment valve port 67, which interference effectively interrupts communication between the annular cylindrical chamber 63 and pocket 57. The result is the diversion of hydraulic fluid through the lead line 75, the two position Up-Level solenoid valve 76, and the branch line 77 into the interior of the cylindrical guideway 46 which is itself an extension of pocket 57.

Figure 3:
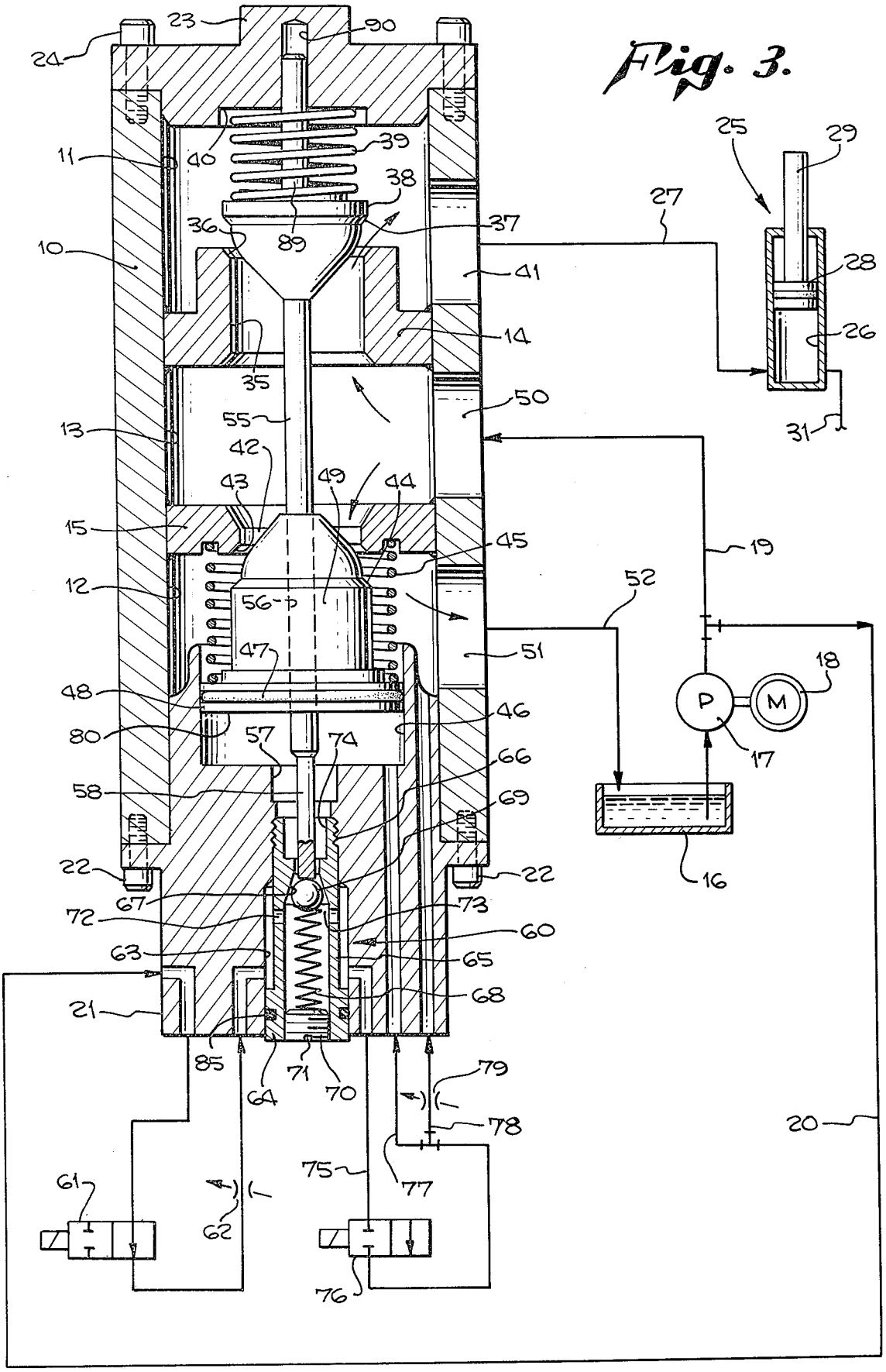
FIG. 3 is a longitudinal sectional view similar to FIGS. 1 and 2 showing the position of parts during up level.

At this time, the piston rod 29 is extending at full velocity as determined by its area and the displacement of the pump 17 and at some appropriate point of travel, suitable conventional mechanical and electrical devices cause the two position Up-Level solenoid valve 76 to be de-energized and move to the right as shown in FIG. 3. The result of the foregoing activity effectively terminates all communication between the lead line 75 and the extension of pocket 57 which comprises the interior of the cylindrical guideway 46, leaving an unbiased communication between said interior and bypass return orifice 51 through adjustable restriction 79 which unbiased communication causes a drop in pressure within pocket 57.

By reason of the pressure drop the piston 49 is no longer urged upwardly but contrarily is urged downwardly by the combined forces of spring 45 and the high energy hydraulic fluid at inflow chamber 13 against the upper conical face of piston 49, which downward insistence causes piston 49 to move axially downwardly at a rate determined by the setting of the adjustable restrictor 79. The bypass passageway 42 is then opened gradually to receive some of the high energy hydraulic fluid causing a diversion of a portion of said fluid into reservoir 16 through return orifice 51 and return line 52 at substantially atmospheric pressure. The diversion causes a reduction in displacement of high energy hydraulic fluid through the check valve passage 35 with an accompanying reduction of upward velocity of piston rod 29 and subsequent lowering of pressure at inflow chamber 13 to the extent that spring 39 becomes predominant against check valve poppet 38 and urges it downwardly towards check valve passage 35, carrying with it stem 55 and its extension 58. The above-described process continues until the extension 58 becomes again intimately engaged against Up-Level adjustment valve element 69 causing its unseating from Up-Level valve port 67.

Communication is re-established between conduit 20 and pocket 57 thereby re-admitting high energy hydraulic fluid into said pocket 57. Once again the high energy hydraulic fluid is impressed against the lower face 80 of piston 49 re-establishing the proportional opposition of forces as herebefore described. This causes a cessation of downward movement of piston 49 with the accompanying cessation of downward movement of check valve poppet 38. A balance of forces is established between spring 39 and the pressure differential then in existence between check valve passage 35 and the up travel supply orifice 41.

At this point, the upward velocity of piston rod 29 is substantially reduced and with the balance of forces established, the velocity of piston rod 29 will remain constant.

Should the Up-Level velocity be either too fast or too slow, manipulation of the Up-Level adjustment valve device 60 by means of the adjusting screw 70 will position the Up-Level adjustment valve port 67 to allow a repositioning of the various parts heretofore described so as to re-establish the necesary balance of forces. The adjustment is readily accomplished from the exterior of the valve and the parts being limited in number and simple in construction makes a fine adjustment possible with relative ease.

Finally, with the velocity of piston rod 29 firmly established at a reduced rate, means must be employed to satisfactorily stop the upward movement and once again suitable conventional mechanical and electrical devices are employed to de-energize the Up-Down solenoid 61 at a predetermined point of travel so as to cause it to move to the right as shown in FIG. 1 thereby terminating effectively all communication between conduit 20 and pocket 57. Once again there exists an unbiased communication between said pocket 57 and the bypass return orifice 51 through the adjustable restrictor 79.

The unbiased communication causes the previously described series of events to transpire so that the full displacement of the pump 17 is returned to the reservoir 16 through the bypass passageway 42. This action effectively reduces the pressure at the inflow chamber 13 below that necessary to maintain a balance against spring 39. The spring 39 at this stage of operation effectively urges the check valve poppet 38 downwardly until the check valve element 37 seats intimately against check valve seat 36. Complete discontinuity of communication between inflow chamber 13 and up travel supply orifice 41 results subsequently and finally causing the piston rod 29 to arrest its upward travel and to hold its given position.

The apparatus is now recycled and ready for the next up movement having no part in necessary downward movements of piston rod 29 which downward movements are accomplished by the operation of the down travel two-position solenoid 30 shown generally in FIG. 1.

While the invention has been disclosed and described in detail in the foregoing, it is to be considered as illustrative and not restrictive, as those skilled in the art will, upon inspection of this disclosure, develop modifications readily within the broad scope of this invention, reference being had to the appended claims.

We claim:

1. A unitary up level control valve device for a hydraulic elevator ram operating from a source of hydraulic fluid pressure comprising:

a housing having a first partition forming an up travel supply chamber adjacent one end;

a second partition forming a bypass chamber adjacent the other end and an inflow chamber intermediate said partitions and in communication with said source of fluid pressure;

a check valve passage through said first partition having a check valve seat and a check valve element normally biased to seated position thereon;

a bypass passage through said second partition having a bypass valve seat and a bypass valve element adapted to seat thereon, an up level adjustment supply line from said source;

an up level adjustment passageway in communication between said adjustment supply line and said bypass valve and having an up level valve seat therein;

an up level adjustment valve element normally biased in a direction to seat on said up level valve seat;

valve guiding means for said valve element comprising a stem section on said check valve element and a stem section extending slidably through said bypass valve element to a position of engagement with said adjustment valve element and a bleed line in communication between said up level adjustment supply line and jointly with said bypass valve element and said bypass chamber;

there being a two position up level solenoid valve device in said bleed line movable between an open position for said bleed line when said check valve is open and a closed position when said check valve and said bypass valve are partially open whereby to diminish the speed of up travel of said ram.

2. A unitary up level control valve device as in claim 1 wherein said up level adjustment valve seat and valve element therefor have complementary configurations and wherein said last defined valve element is in axial alignment with the stem section on said check valve element.

3. A unitary up level control valve device as in claim 2 wherein said up level valve seat is carried by a sleeve and said sleeve is axially adjustable relative to said housing.

4. A unitary up level control valve device as in claim 2 wherein the stem section of said check valve element extends through said bypass valve element and there is a releasable engagement between said stem sections and said up level adjustment valve element in closed position of said check valve element.

5. A unitary up level control valve device as in claim 1 wherein there is a cylindrical guideway in said first partition for said check valve element and a cylindrical guideway in said second partition for said bypass valve element.

6. A unitary up level control valve device as in claim 1 wherein there is a cylindrical guideway at the lower end of the housing for said bypass valve element, an annular seal between said cylindrical guideway and said bypass valve element, there being a pocket in said guideway beneath said bypass valve element in communication with said up level adjustment valve seat and with said bleed line.

7. A unitary up level control valve device as in claim 6 wherein there is a branch of said bleed line making the communication with said bypass chamber and an adjustable restriction in said branch of said bleed line.

8. A unitary up level control valve device as in claim 1 wherein there is a two position up dump solenoid valve device in said up level adjustment supply line which when in open position passes fluid pressure for up travel of said ram to said bypass valve element whereby to close said bypass valve element and effect opening movement of said check valve element.

9. A unitary up level control valve device as in claim 8 wherein there is an adjustable restriction in said up level adjustment supply line whereby to adjust the rate of closing of said bypass valve element.

* * * * *